US010634140B2

(12) United States Patent
Kuwahara et al.

(10) Patent No.: US 10,634,140 B2
(45) Date of Patent: Apr. 28, 2020

(54) SCROLL COMPRESSOR WITH STEP

(71) Applicant: MITSUBISHI HEAVY INDUSTRIES THERMAL SYSTEMS, LTD., Minato-ku, Tokyo (JP)

(72) Inventors: Takayuki Kuwahara, Aichi (JP); Katsuhiro Fujita, Aichi (JP); Takayuki Hagita, Aichi (JP); Makoto Takeuchi, Tokyo (JP); Hajime Sato, Tokyo (JP); Genta Yoshikawa, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 234 days.

(21) Appl. No.: 15/555,805

(22) PCT Filed: Feb. 19, 2016

(86) PCT No.: PCT/JP2016/054956
§ 371 (c)(1),
(2) Date: Sep. 5, 2017

(87) PCT Pub. No.: WO2016/152351
PCT Pub. Date: Sep. 29, 2016

(65) Prior Publication Data

US 2018/0045199 A1 Feb. 15, 2018

(30) Foreign Application Priority Data

Mar. 20, 2015 (JP) ..... 2015-057645

(51) Int. Cl.
*F01C 1/02* (2006.01)
*F03C 2/00* (2006.01)
(Continued)

(52) U.S. Cl.
CPC ..... *F04C 18/0276* (2013.01); *F04C 18/0215* (2013.01); *F04C 18/0246* (2013.01);
(Continued)

(58) Field of Classification Search
CPC ..... F04C 18/0215; F04C 18/0246; F04C 18/0269; F04C 18/0276; F04C 23/008;
(Continued)

(56) References Cited

U.S. PATENT DOCUMENTS 4,477,238 A * 10/1984 Terauchi ..... F04C 18/0269 418/55.2
4,626,179 A 12/1986 Terauchi
(Continued)

FOREIGN PATENT DOCUMENTS

JP 60-104788 A 6/1985
JP 6-330863 A 11/1994
(Continued)

OTHER PUBLICATIONS

Written Opinion of the International Searching Authority and International Search Report (forms PCT/ISA/237 and PCT/ISA/210), dated May 24, 2016, for International Application No. PCT/JP2016/054956, with English translations.

*Primary Examiner* — Theresa Trieu
(74) *Attorney, Agent, or Firm* — Birch, Stewart, Kolasch & Birch, LLP

(57) ABSTRACT

In a scroll compressor that forms two suction volume parts by engaging paired fixed scroll and turning scroll with each other while scroll laps respectively erected on end plates of the fixed scroll and the turning scroll are opposed to each other and driving the turning scroll to revolve around the fixed scroll, out of the two suction volume parts, one of the
(Continued)

suction volume parts that is formed close to a suction port provided in a housing is made larger than the other suction volume part.

3 Claims, 5 Drawing Sheets

(51) Int. Cl.
*F03C 4/00* (2006.01)
*F04C 18/02* (2006.01)
*F04C 29/12* (2006.01)

(52) U.S. Cl.
CPC ..... *F04C 18/0269* (2013.01); *F04C 29/12* (2013.01); *F04C 2230/60* (2013.01); *F04C 2240/30* (2013.01)

(58) Field of Classification Search
CPC .. F04C 29/12; F04C 2230/60; F04C 2240/30; F01C 1/0215; F01C 1/0246; F01C 1/0269; F01C 1/0276
USPC ..... 418/55.1–55.6, 57
See application file for complete search history.

(56) References Cited

U.S. PATENT DOCUMENTS 5,059,102 A * 10/1991 Tokumitsu ..... F04C 18/0269 418/55.2
6,746,224 B2 6/2004 Itoh et al.
6,764,288 B1 * 7/2004 Liepert ..... F04C 18/0215 418/55.1
2006/0177332 A1 * 8/2006 Kim ..... F04C 18/0269 418/55.2
2009/0208356 A1 * 8/2009 Ginies ..... F04C 18/0269 418/55.2
2012/0263615 A1 10/2012 Iizuka et al.
2014/0308146 A1 * 10/2014 Hirata ..... F04C 18/0269 418/55.2

FOREIGN PATENT DOCUMENTS

JP 11-82326 A 3/1999
JP 2002-70769 A 3/2002
JP 2011-85066 A 4/2011

* cited by examiner

SCROLL COMPRESSOR WITH STEP

TECHNICAL FIELD

The present invention relates to a scroll compressor that makes it possible to further improve volumetric efficiency and refrigerating capacity.

BACKGROUND ART

A scroll compressor is configured such that paired fixed scroll and turning scroll engage with each other while scroll laps respectively erected on end plates of the fixed scroll and the turning scroll are opposed to each other, and the turning scroll is driven to revolve around the fixed scroll, thereby forming two suction volume parts with a phase difference of 180 degrees. Further, moving the suction volume parts from an outer peripheral side toward a center side while respective volumes thereof are decreased, to compress low-pressure refrigerant gas sucked into the suction volume part to high pressure, and the high-pressure refrigerant gas is discharged. Furthermore, typically, the respective volumes of the two suction volume parts formed with the phase difference of 180 degrees are made equal to each other in order to prevent inner pressure of the two suction volume parts from being unbalanced.

In contrast, Patent Citation 1 discloses a scroll compressor in which respective winding finish ends of scroll laps of paired fixed scroll and turning scroll disposed in a housing are placed at upper positions as much as possible, and the winding finish end of one of the scrolls is disposed at a position higher than a center part of a winding start end and the winding finish end of the other scroll is extended toward the winding finish end of the one scroll in order to avoid suction of oil in an oil sump and liquid refrigerant.

In addition, Patent Citation 2 discloses a scroll compressor in which a fixed scroll is integrally formed with a housing, a suction port is opened for communication at a winding finish end of a scroll lap of the fixed scroll, and a winding finish end of a turning scroll that engages with the fixed scroll is placed at the substantially same position. In the scroll compressor, low-temperature refrigerant gas sucked through the suction port is sequentially sucked directly into two suction volume parts, which suppresses overheat degree of the suction refrigerant gas and increase of a specific volume to achieve performance improvement.

CITATION LIST

Patent Citation

Patent Citation 1: Japanese Unexamined Patent Application, Publication No. H06-330863 (the Publication of Japanese Patent. No. 2874514)

Patent Citation 2: Japanese Unexamined Patent Application, Publication No. H11-82326 (the Publication of Japanese Patent No. 3869082)

DISCLOSURE OF INVENTION

As described above, in the scroll compressor that forms two suction volume parts with the phase difference of 180 degrees, temperature of the refrigerant gas socked into one of the suction volume parts may in some cases be higher than temperature of the refrigerant gas sucked into the other suction volume part, depending on the position of the suction port provided in the housing. This is because the suction path of the refrigerant gas inside the housing is longer, and the refrigerant gas is heated by coming into contact with mechanical parts such as a bearing and a turning drive section in the middle of the suction path. It is possible to cool and lubricate the mechanical parts but the density of the refrigerant sucked into the other suction volume part is decreased by suction overheating, which may deteriorates volumetric efficiency and refrigerating capacity.

In addition, in the scroll compressor disclosed in Patent Citation 1, the number of turns is increased by extending the winding finish end of the scroll lap of one scroll that is away from the suction port. In this case, it is possible to prevent liquid compression caused by sucking of oil and liquid refrigerant but improvement of volumetric efficiency and refrigerating capacity is not expected. In addition, in the scroll compressor disclosed in Patent Citation 2, the winding finish end of the scroll lap of the fixed scroll is extended to prevent overheat of the refrigerant gas and increase of the specific volume, and to achieve performance improvement. Therefore, improvement of volumetric efficiency and refrigerating capacity is expected but cooling and lubricating effects of the low-temperature refrigerant gas and oil contained in the refrigerant for the mechanical parts are not expected. Accordingly, it is necessary to take measures for lubricating and to secure service life of the equipment, separately.

The present invention is made in consideration of such circumstances, and an object of the present invention is to provide a scroll compressor that increases displacement to improve volumetric efficiency and refrigerating capacity while securing cooling performance and lubricity of the suction refrigerant gas for the mechanical parts, thereby achieving both of the effects.

A scroll compressor according to a first aspect of the present invention forms two suction volume parts by engaging paired fixed scroll and turning scroll with each other while scroll laps respectively erected on end plates of the fixed scroll and the turning scroll are opposed to each other and driving the turning scroll to revolve around the fixed scroll, in which out of the two suction volume parts, one of the suction volume parts that is formed close ho a suction port provided in a housing is made larger than the other suction volume part.

According to the first aspect of the present invention, in the scroll compressor that forms the two suction volume parts by engaging the pared fixed scroll and turning scroll with each other, out of the two suction volume parts, one of the suction volume parts that is formed close to the suction port provided in the housing is made lager than the other suction volume part. This makes it possible to efficiently suck low-temperature refrigerant, with high density near the suction port, and to effectively increase the suction amount of the refrigerant. Accordingly, it is possible to increase the displacement by the amount, and to improve the volumetric efficiency and the refrigerating capacity of the compressor. In addition, the mechanical parts such as bearing parts are cooled and lubricated by the refrigerant gas that is sucked into the suction volume part (the compression chamber) away from the suction port, and cooling performance and lubricity are secured. This makes it possible to achieve both of securement of service life of the equipment and high performance of the compressor by improvement of the volumetric efficiency.

Further, in the above-described scroll compressor according to the first aspect of the present invention, the suction volume part formed close to the suction port is made larger by increasing the number of turns of the scroll lap of one of the scrolls.

According to the first aspect of the present invention, the suction volume part formed close to the suction port is made larger by increasing the number of turns of the scroll lap of the one scroll. This makes it possible to effectively suck the lower-temperature refrigerant with high density near the suction port and to effectively increase the suction amount of the refrigerant. Accordingly, it is possible to increase the displacement by the amount and to easily improve volumetric efficiency and refrigerating capacity of the compressor only by increasing the number of turns of the scroll lap of one of the scrolls. In addition, securing cooling performance and lubricity of the suction refrigerant gas for the mechanical parts makes it possible to achieve both of securement of service life of the equipment and high performance of the compressor by improvement of the volumetric efficiency.

Further, in the above-described scroll compressor according to the first aspect of the present invention, each of the fixed scroll and the turning scroll includes step parts at respective predetermined positions, along a spiral direction, of a tooth crest and a bottom land of the scroll lap. Further, a volume of the suction volume part formed close to the suction port is made larger by making a height of the step part of the tooth crest of the scroll forming the suction volume part higher than a height of the step part of the tooth crest of the other scroll.

According to the first aspect of the present invention, each of the fixed scroll and the turning scroll includes the step parts at the respective predetermined positions, along the spiral direction, of the tooth crest and the bottom land of the scroll lap. Further, the volume of the suction volume part formed close to the suction port is made larger by making the height of the step part of the tooth crest of the scroll forming the suction volume part higher than the height of the step part of the tooth crest of the other scroll. Therefore, in the so-called scroll with both side steps, it is possible to efficiently suck the low-temperature refrigerant with high density near the suction port and to effectively increase the suction amount of the refrigerant. Accordingly, it is possible to increase the displacement by the amount, and to easily improve the volumetric efficiency and the refrigerating capacity of the compressor only by making the height of the step part on the tooth crest side of the one scroll higher. In addition, securing cooling performance and lubricity of the suction refrigerant gas for the mechanical parts makes it possible to achieve both of securement of service life of the equipment and high performance of the compressor by improvement of the volumetric efficiency.

Further, in the above-described scroll compressor according to the first aspect of the present invention, one of the fixed scroll and the turning scroll includes a step part only at a predetermined position, along a spiral direction, of a bottom land of the scroll lap, and the other scroll includes a step part only at a predetermined position, along a spiral direction, of a tooth crest of the scroll lap. The predetermined position of the tooth crest corresponds to the step part of the bottom land. Further, the suction volume part formed close to the suction port is made larger by providing a step part only on the tooth crest of the scroll forming the suction volume part.

According to the first aspect of the present invention, one of the fixed scroll and the turning scroll includes the step part only at the predetermined position, along the spiral direction, of the bottom land of the scroll lap, and the other scroll includes the step part only at the predetermined position, along the spiral direction, of the tooth crest of the scroll lap. The predetermined position of the tooth crest corresponds to the step part of the bottom land. Further, the suction volume part formed close to the suction port is made larger by providing the step part only on the tooth crest of the scroll forming the suction volume part. Therefore, in a so-called scroll with one side step, it is possible to efficiently suck the lower-temperature refrigerant with high density near the suction port and to effectively increase the suction amount of the refrigerant. Accordingly, it is possible to increase the displacement by the amount, and to easily improve the volumetric efficiency and the refrigerating capacity of the compressor only by providing the step part on the tooth crest of the one scroll forming the suction volume part. In addition, securing cooling performance, and lubricity of the suction refrigerant gas for the mechanical parts makes it possible to achieve both of securement of service life of the equipment and high performance of the compressor by improvement of the volumetric efficiency.

Further, a scroll compressor according to a second aspect of the present invention forms two suction volume parts by engaging paired fixed scroll and turning scroll with each other while scroll laps respectively erected on end plates of the fixed scroll and the turning scroll are opposed to each other and driving the turning scroll to revolve around the fixed scroll, in which out of surface areas of the both scrolls forming the two suction volume parts, a surface area of the end plate of the turning scroll that is disposed to face a suction region of low-temperature refrigerant gas sucked through a suction port provided in a housing is made larger than a surface area of the end plate of the fixed scroll.

According to the second aspect of the present invention, in the scroll compressor that forms the two suction volume parts by engaging the paired fixed scroll and turning scroll with each other, out of the surface areas of the both scrolls forming the two suction volume parts, the surface area of the end plate of the turning scroll that is disposed to face the suction, region of the low-temperature refrigerant gas sucked through the suction port provided in the housing is made larger than the surface area of the end plate of the fixed scroll. Therefore, heat transfer function thereof maintains the temperature inside the suction volume part at lower temperature to improve suction efficiency, which makes it possible to effectively increase the suction amount of the refrigerant. Accordingly, it is possible to increase the displacement by the amount and to improve the volumetric efficiency and the refrigerating capacity of the compressor. In addition, the mechanical parts such as bearing parts are cooled and lubricated by the refrigerant gas that is sucked into the suction volume part away from the suction port, and cooling performance and lubricity are secured. This makes it possible to achieve both of securement of service life of the equipment and high performance of the compressor by improvement of the volumetric efficiency.

Further, in the above-described scroll compressor according to the second aspect of the present invention, each of the fixed scroll and the turning scroll includes step parts at respective predetermined positions, along a spiral direction, of a tooth crest and a bottom land of the scroll lap, and a surface area of the end plate of the turning scroll forming the suction volume part is made larger by making a height of the step part provided on the bottom land of the turning scroll higher than a height of the step part provided on the bottom land of the fixed scroll.

According to the second aspect of the present invention, each of the fixed scroll and the turning scroll includes the step parts at the respective predetermined positions, along the spiral direction, of the tooth crest and the bottom land of the scroll lap, and out of surface areas of end plates of the both scrolls forming the suction volume parts, the surface area of the end plate of the turning scroll that is disposed to face a suet ion region of low-temperature refrigerant gas sucked, through a suction port provided in a housing is made larger by making the height of the step part provided on the bottom land of the turning scroll higher than the height of the step part provided on the bottom land of the fixed scroll. Therefore, in the scroll with both side steps, heat transfer function thereof maintains the temperature inside the suction volume part at lower temperature to improve suction efficiency, which makes it possible to effectively increase the suction amount of the refrigerant. Accordingly, it is possible to easily improve the volumetric efficiency and the refrigerating capacity of the compressor only by making the height or the step part provided on the end plate or the turning scroll higher to increase the surface area. In addition, securing cooling performance and lubricity of the suction refrigerant gas for the mechanical parts makes it possible to achieve both of securement of service life of the equipment and high performance of the compressor by improvement of the volumetric efficiency.

Further, in the above-described scroll compressor according to the second aspect of the present invention, one of the fixed scroll, and the turning scroll includes a step part only at a predetermined position, along a spiral direction, of a bottom land of the scroll lap, and the other scroll includes a step part only at a predetermined position, along a spiral direction, of a tooth crest of the scroll lap. The predetermined position of the tooth crest corresponds to the step part of the bottom land. Further, a surface area of the end plate of the turning scroll forming the suction volume part is made larger by providing the step part only on the bottom land of the turning scroll.

According to the second aspect of the present invention, one of the fixed scroll and the turning scroll includes the step part only at the predetermined position, along a spiral direction, of the bottom land of the scroll lap, and the other scroll includes the step part only at the predetermined position, along the spiral direction, of the tooth crest of the scroll lap. The predetermined position of the tooth crest corresponds to the step part of the bottom land. Further, out of the surface areas of the end plates of the both scrolls forming the suction volume parts, the surface area of the end plate of the turning scroll that is disposed to face a suction region of low-temperature refrigerant gas sucked through a suction port provided in a housing is made larger by providing the step part only on the bottom land of the turning scroll. Therefore, in the so-called scroll with one side step, heat transfer function thereof maintains the temperature inside the suction volume part at lower temperature to improve suction efficiency, which makes it possible to effectively increase the suction amount of the refrigerant. Accordingly, it is possible to easily improve the volumetric efficiency and the refrigerating capacity of the compressor by the amount only by providing the step part on the end plate of the turning scroll to increase the surface area. In addition, securing cooling performance and lubricity of the suction refrigerant gas for the mechanical parts makes it possible to achieve both of securement of service life of the equipment and high performance of the compressor by improvement of the volumetric efficiency.

According to the present invention, one suction volume part that is located close to the suction port and sucks lower-temperature refrigerant gas is made larger than the other suction volume part. This makes it possible to efficiently sack the low-temperature refrigerant with high density to effectively increase the suction amount of the refrigerant. Accordingly, it is possible to increase the displacement by the amount and to improve the volumetric efficiency and the refrigerating capacity of the compressor. In addition, the mechanical parts such as bearing parts are cooled and lubricated by the refrigerant gas that is sucked into the suction volume part away from the suction port, and cooling performance and lubricity are secured. This makes if possible to achieve both of securement of service life of the equipment and high performance of the compressor by improvement of the volumetric efficiency.

Furthermore, according to the present invention, out of the surface areas of the end plates of the both scrolls forming the two suction volume parts, the surface area of the end plate of the turning scroll that is disposed to face the suction region into which the low-temperature refrigerant gas is sucked, is made larger than the surface area of the end plate of the fixed scroll. This makes it possible to maintain the temperature inside the suction volume part at lower temperature to improve the suction efficiency, and to effectively increase the suction amount of the refrigerant. Accordingly, it is possible to improve the volumetric efficiency and the refrigerating capacity of the compressor by the amount. In addition, the mechanical parts such as bearing parts are cooled and lubricated by the refrigerant gas that is sucked into the suction volume part away from the suction port, and cooling performance and lubricity are secured. This makes it possible to achieve both of securement of service life of the equipment and high performance of the compressor by improvement of the volumetric efficiency.

DESCRIPTION OF EMBODIMENTS

Some embodiments of the present invention are described below with reference to drawings.

First Embodiment

A first embodiment of the present invention is described below with reference to FIG. 1 to FIG. 3.

Figure 1:
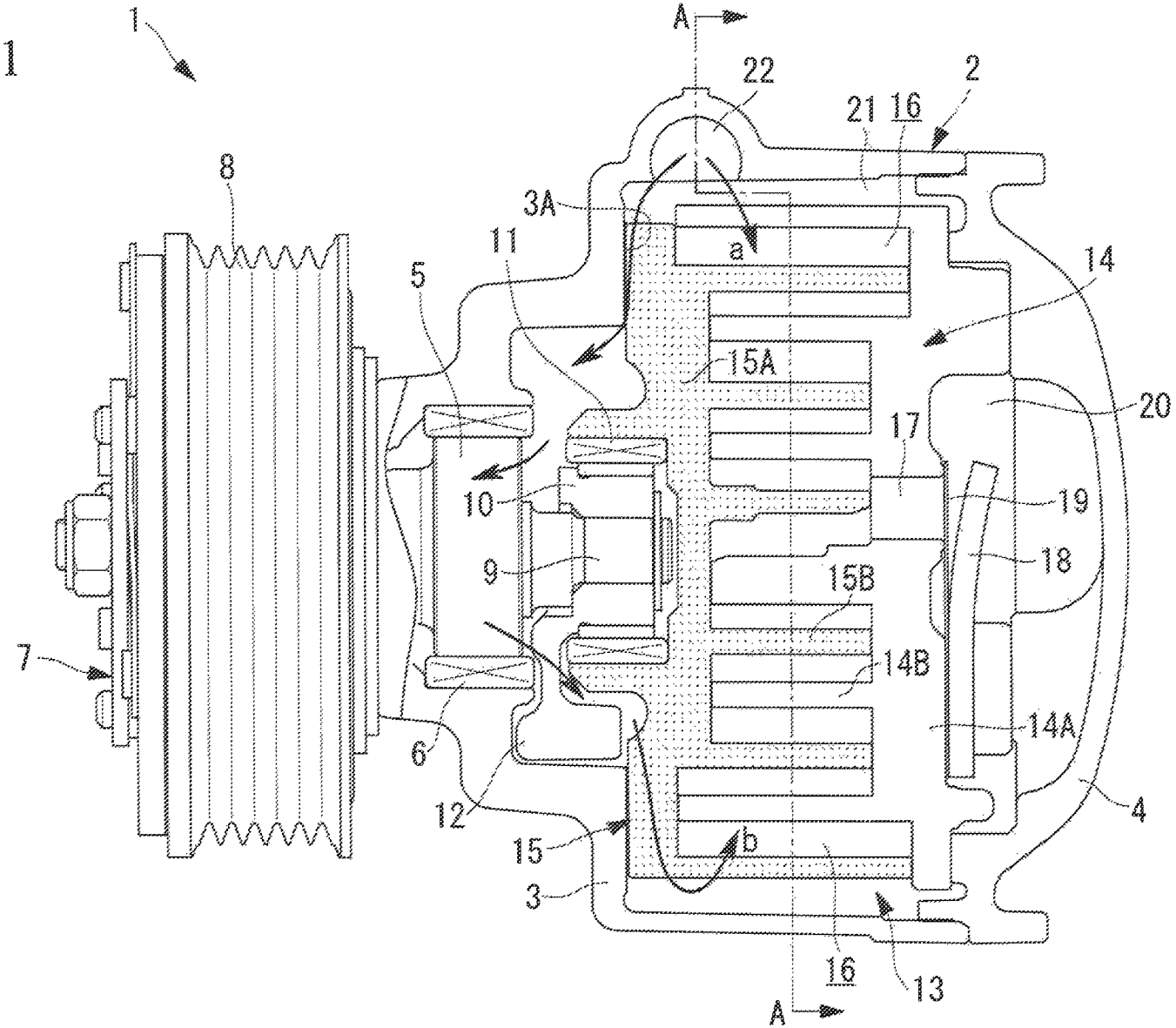
FIG. 1 is a vertical cross-sectional diagram of a scroll compressor according to a first embodiment of the present invention.

FIG. 1 is a vertical cross-sectional diagram of a scroll compressor according to the first embodiment of the present invention. FIG. 3 is a diagram corresponding to a cross-sectional surface taken along line A-A in FIG. 1, FIG. 3 is an explanatory diagram of a state in which a fixed scroll and a turning scroll of the scroll compressor engage with each other.

The scroll compressor 1 includes a cylindrical housing 2 that configures an outer shell. The housing 2 is configured by integrally fastening and fixing a front housing 3 and a rear housing 4 through an unillustrated bolt or the like.

A crank shaft 5 is supported to be rotatable around an axis through a main bearing 6 and a sub-bearing (not illustrated), on the front housing 3 side inside the housing 2. One end (left side in FIG. 1) of the crank shaft 5 projects on the left side in FIG. 1 through the front housing 3, and an electromagnetic clutch 7 and a pulley 8 that receive power in the well-known manner are provided on a projected part. The crank shaft 5 can receive power from a drive source such as an engine, through a belt. A mechanical seal or a lip seal is provided between the main bearing 6 and the sub-bearing, thereby sealing a gap between the inside of the housing 2 and the atmosphere.

A crank pin 9 that is eccentric from the axis of the crank shaft 5 by a predetermined dimension is integrally provided on the other end (right side in FIG. 1) of the crank shaft 5. The crank pin 9 is coupled to a turning scroll 15 described later through a drive bush 10 and a drive bearing 11. The crank pin 9 turns the turning scroll 15 through rotation drive of the crank shaft 5.

A balance weight 12 is integrally provided on the drive bush 10 and turns in conjunction with the turning drive of the turning scroll 15. The balance weight 12 removes an unbalanced load that occurs when the turning scroll 15 turns. In addition, a well-known driven crank mechanism that varies a turning radius of the turning scroll 15 is provided between the drive bush 10 and the crank pin 9.

A scroll compression mechanism 13 that includes paired fixed scroll 14 and turning scroll 15 is incorporated in the housing 2. The fixed scroll 14 includes an end plate 14A and a scroll lap 14B that is erected on the end plate 14A. The turning scroll 15 includes an end plate 15A and a scroll lap 15B that is erected on the end plate 15A.

Figure 2:
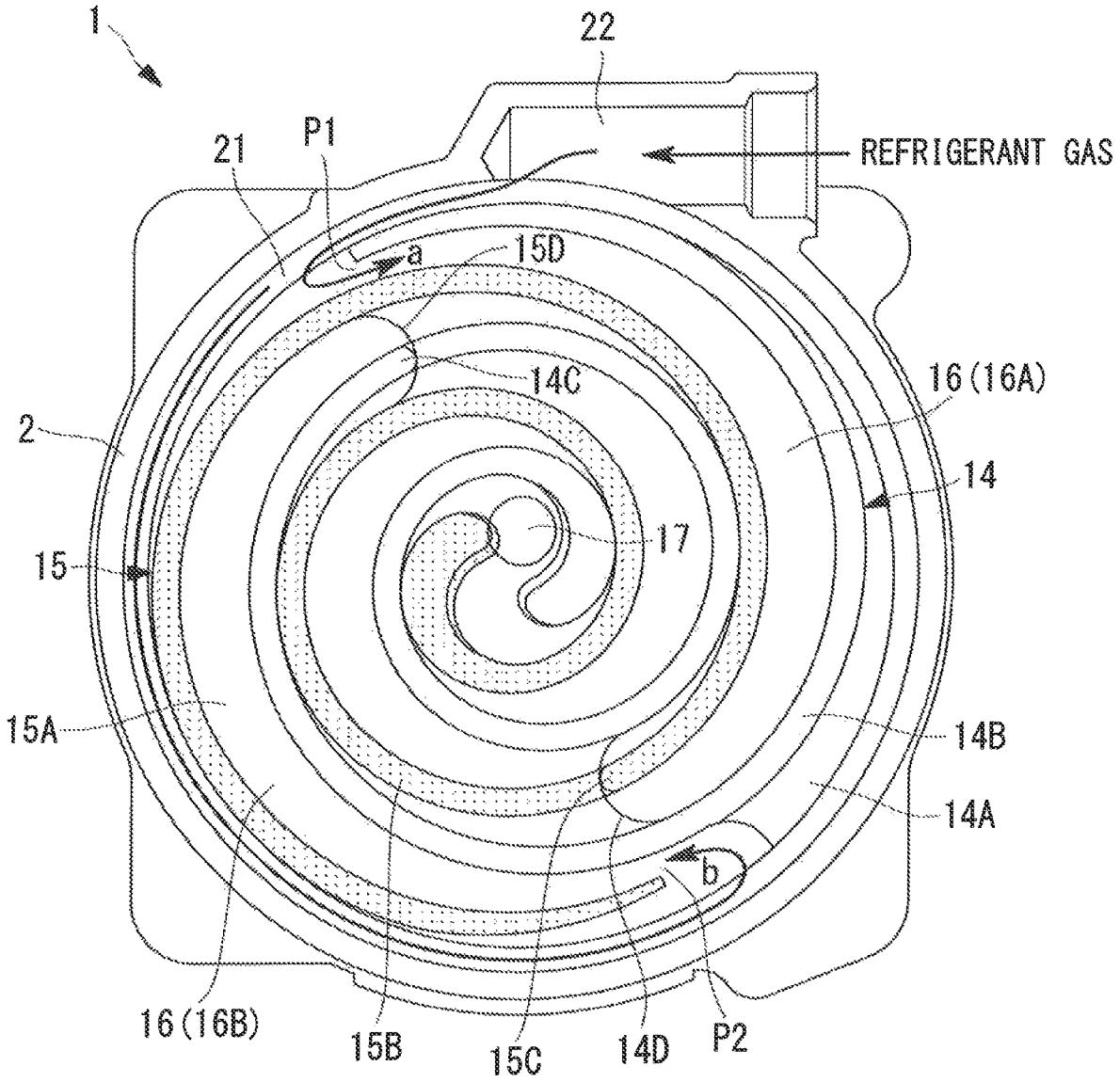
FIG. 2 is a diagram corresponding to a cross-sectional surface taken along line A-A in FIG. 1.
Figure 3:
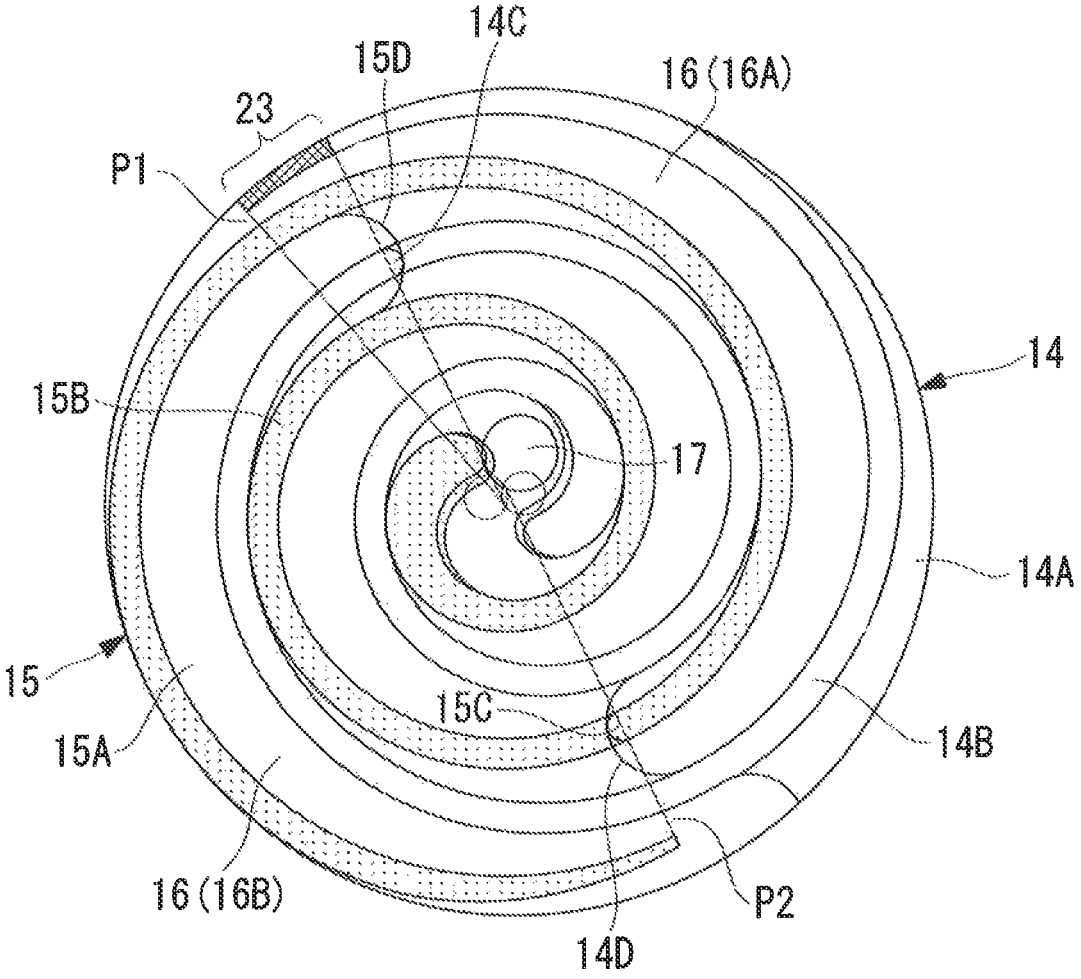
FIG. 3 is an explanatory diagram of a state in which a fixed scroll and a turning scroll of the above-described scroll compressor engage with each other.

As illustrated in FIG. 2 and FIG. 3, the fixed scroll 14 includes step parts 14C and 14D at respective predetermined positions, along a spiral direction, of a tooth crest and a bottom land of the scroll lap 14B. Likewise, the turning scroll 15 includes step parts 15C and 15D at respective predetermined positions, along a spiral direction, of a tooth crest and a bottom land of the scroll lap 15B. On the tooth crest side of the lap with the step parts 14C, 15C, 14D, and 15D as boundary, the tooth crest on an outer peripheral side in a turning axis direction is made high and the tooth crest on an inner peripheral side is made low. In addition, on the bottom land side, the bottom land on the outer peripheral side in the turning axis direction is made low and the bottom land on the inner peripheral side is made high. Therefore, each of the scroll laps 14B and 15B has a lap height on the outer peripheral side higher than the lap height on the inner peripheral side.

The fixed scroll 14 and the turning scroll 15 are assembled such that the respective centers are separated from each other by a turning radius, the scroll laps 14B and 15B are opposed to each other and engage with each other while a phase is shifted by 180 degrees from each other, and a slight clearance (several tens micron to several hundred micron) is provided between the tooth crest of the scroll lap 14B and the bottom land of the scroll lap 15B and between the tooth crest of the scroll lap 15B and the bottom land of the scroll lap 14B, at ambient temperature. As a result, paired suction volume parts (compression chambers) 16 are formed with a phase difference of 180 degrees with respect to a scroll center, between the scrolls 14 and 15. The suction volume parts 16 are defined by the end plates 14A and 15A and the scroll laps 14B and 15B.

The height of each of the suction volume parts (the compression chambers) 16 in the turning axis direction of the scroll laps 14B and 15B is made higher on the outer peripheral side than on the inner peripheral side. The suction volume parts (the compression chambers) 16 configure the scroll compression mechanism 13 that performs three-dimensional compression to compress gas in both of a circumferential direction and a lap height direction of the scroll laps 14B and 15B. Note that the compression mechanism 13 is a so-called scroll compression mechanism 13 with both side steps that includes the step parts 14C, 15C, 14D, and 15D as described above; however, the compression mechanism 13 may be a conventional scroll, compression mechanism of two-dimensional compression type without steps as a matter of course.

The fixed scroll 14 is fixed to and provided on an inner surface of the rear housing 4 through an unillustrated bolt or the like. In addition, the turning scroll 15 is turnable by coupling the crank pin 9 provided on the one end of the a crank shaft 5 as described above to a bearing boss part through the drive bush 10 and the drive bearing 11. The bearing boss part is provided on a rear surface of the end plate 15A. Further, the rear surface of the end plate 15A is supported by a thrust bearing surface 3A of the front housing 3, and the turning scroll 15 revolves around the fixed scroll 14 while being prevented from rotating, through an unillustrated rotation prevention mechanism. The rotation prevention mechanism is provided between the thrust bearing surface 3A and the rear surface of the end plate 15A.

A discharge port 17 that discharges compressed refrigerant gas is opened at a center part of the end plate 14A of the fixed scroll 14. A discharge reed valve 19 is provided on the discharge port 17 through a retainer 18. In addition, a seal member such as an O-ring is interposed between a rear surface on the outer peripheral side of the end plate 14A of the fixed scroll 14 and the inner surface of the rear housing 4. A space on the inner peripheral side of the seal member is a discharge chamber 20 partitioned from the internal space of the housing 2, and the high-temperature high-pressure compressed gas is discharged through the discharge port 17. Moreover, the internal space of the housing 2 is partitioned into the discharge chamber 20 and other suction region 21 through partitioning by the seal member.

A suction port 22 that is provided at an upper part of the front housing 3 is opened in the suction region 21 inside the housing 2, and low-temperature low-pressure refrigerant gas is sucked from a refrigerating cycle side. The low-temperature low-pressure refrigerant gas sucked into the suction region 21 is sucked into the two suction volume parts (the compression chambers) 16 that are provided between the turning scroll 15 and the fixed scroll 14 with a phase difference of 180 degrees, and is compressed by the turning of the turning scroll 15.

In such a scroll compressor 1, respective winding finish ends of the scroll laps 14B and 15B of the fixed scroll 14 and the turning scroll 15 configuring the scroll compression mechanism 13 are disposed in an up-down direction. The winding finish end of the scroll lap 14B of the fixed scroll 14 is disposed at an upper position and the winding finish end of the scroll lap 15B of the turning scroll 15 is disposed at a lower position. The upper position and the lower position are inclined by a predetermined angle from respective vertical, positions.

Accordingly, in the scroll compressor 1, a suction position P1 for the suction volume part 16A, suction of which is stopped by the winding finish end of the scroll lap 14B of the fixed scroll 14 is disposed at a position close to the suction port 22 than a suction position P2 for the suction volume part 16B, suction of which is stopped by the winding finish end of the scroll lap 15B of the turning scroll 15. The low-temperature refrigerant gas sucked into the suction region 21 through the suction port 22 is directly sucked into the suction volume part 15A whereas the low-temperature refrigerant gas is sucked into the suction volume part 16A by going around to a position opposite by 180 degrees while being in contact with the mechanical parts such as the bearings 6 and 11 and the drive bush 10.

In other words, the low-temperature refrigerant gas sucked through the suction port 22 is directly sucked into the suction volume part 16A close to the suction port 22 as illustrated by an arrow a. In contrast, the low-temperature refrigerant gas is sucked into the suction volume part 16B away from the suction port 22 through a suction path that comes into contact with the bearings 6 and 11 and the drive bush 10, after the low-temperature refrigerant gas is sucked into the suction region 21 through the suction port 22, as illustrated by an arrow b. In the middle of the path, the low-temperature refrigerant gas and oil drops contained in the gas are used to cool and lubricate the mechanical parts such as the bearings 6 and 11 and the drive bush 10.

In the present embodiment, in order to allow the suction volume part 16A close to the suction port 22, namely, the suction volume part 16A, the suction position P1 of which is close to the suction port 22 in linear distance in a central cross-section in a tooth length direction of the scroll laps 14B and 15B (FIG. 2), to suck a larger amount of the low-temperature refrigerant with high density, an increased-number-of-turns section (an winding-finish-end extended part) 23 illustrated by hatching in FIG. 3 is provided with respect to the winding finish end of the scroll lap 14B of the fixed scroll 14 such that out of the two suction volume parts (the compression chambers) 16 formed with the phase difference of 180 degrees, a volume of one suction volume part 16A formed close to the suction port 22 is larger than a volume of the other suction volume part 16B.

According to the present embodiment, the above-described configuration makes it possible to achieve the following function effects.

When the rotational driving force from an external drive source is supplied to the crank shaft 5 through the pulley 8 and the electromagnetic clutch 7 to rotate the crank shaft 5, the turning scroll 15 that is so coupled to the crank pin 9 through the drive bush 10 and the drive bearing 11 as to be variable in turning radius is driven to revolve with a predetermined turning radius around the fixed scroll 14 while the turning scroll 15 is prevented from rotating by the rotation prevention mechanism (not illustrated).

The revolution of the turning scroll 15 causes the low-temperature refrigerant gas that has been sucked into the suction region 21 through the suction port 22 to be sucked into the two suction volume parts (the compression chambers) 16 that are formed on the outermost periphery in the radial direction with the phase difference of 180 degrees. The suction of each of the suction volume parts (the compression chambers) 16 is stopped at a predetermined turning angle, and the volume is moved toward the center side while being decreased in the circumferential direction and the lap height direction, which compresses the refrigerant gas. The paired suction volume parts (the compression chambers) 16 are joined at the center part. When the suction volume parts 16 reach a position communicating with the discharge port 17, the discharge reed valve 19 is pushed to open. As a result, the high-temperature high-pressure compressed gas is discharged into the discharge chamber 20, and is fed from the discharge chamber 20 to the outside of the scroll compressor 1, namely, to the refrigerating cycle side.

The low-temperature refrigerant gas that has been sucked into the suction region 21 through the suction port 22 is directly sucked into the suction volume part (the compression chamber) 16A close to the suction port 22 as illustrated by the arrow a. Therefore, the refrigerant gas is sucked while being kept at low temperature with high density. In contrast, the low-temperature refrigerant gas is sucked into the suction volume part (the compression chamber) 16B away from the suction port 22 through the long suction path that comes into contact with the mechanical parts such as bearings 6 and 11 and the drive bush 10, as illustrated by the arrow b. Therefore, the refrigerant gas is heated in the suction path and is sucked with high overheat degree and low density; however, in the suction path, the refrigerant gas and oil drops contained in the gas cool and lubricate the mechanical parts in contact, which contributes to securement of product service life of the equipment.

Further, out of the two suction volume parts (the compression chambers) 16 formed with the phase difference of 180 degrees, the volume of one suction volume, part 16A close to the suction port 22 provided in the housing 2 is made larger than the volume of the other suction volume part 16B away from the suction port 22. In other words, as illustrated in FIG. 3, the volume of the suction volume part 16A close to the suction port 22 is made larger than the volume of the other suction volume part (the compression chamber) 16B by providing the increased-number-of-turns section 23 on the winding finish end of the scroll lap 14B of the fixed scroll 14. Accordingly, it is possible to efficiently suck the low-temperature refrigerant with higher density and to effectively increase the suction amount of the refrigerant.

As a result, it is possible to increase displacement of the compressor by the increased suction amount of the refrigerant, and to easily improve the volumetric efficiency and refrigerating capacity of the scroll compressor 1 only by increasing the number of tarns of the scroll lap 14B of one fixed scroll 14. In addition, it is possible to cool and lubricate the mechanical parts such as the bearings 6 and 11 and the drive bush 10 by the low-temperature refrigerant gas that is sucked info the suction volume part (the compression chamber) 16B away from, the suction port 22. This makes it possible to achieve both of securement of service life of the equipment and high performance of the compressor 1 by improvement of the volumetric efficiency.

Note that, in the present embodiment, the application example to the so-called scroll with both side steps in which the step parts 14C, 15C, 14D, and 15D, are provided at respective predetermined positions, along the spiral direction, of the tooth crests and the bottom lands of the scroll laps 14B and 15B of the fixed scroll 14 and the turning scroll 15 has been described. Further, in a scroll compressor without the step parts 14C, 15C, 14D, and 15D, the volume of the one suction volume part 16A formed close to the suction port 22 is made larger by increasing the number of turns of the scroll lap of one scroll, which achieves similar effects as a matter of course. Such a scroll compressor is also encompassed in the present invention as a matter of course.

In addition, in the description in the present embodiment, the suction port 22 is provided at the upper part of the outer periphery of the housing 2; however, the position of the suction port 22 is not limited thereto. It is sufficient to provide the suction port 22 on the outer periphery of the housing 2 on an upper side than a straight line that is orthogonal to a straight line connecting the center of the scroll and the winding finish ends of the respective scroll laps 15B and 15B. When the suction port 22 is located within the above-described range, the linear distance between the suction port 22 and the suction position for the suction volume part 15A is smaller than the linear distance between the suction port 22 and the suction position for the suction volume part 16B.

Second Embodiment

Next, a second embodiment of the present invention is described with reference to FIG. 4.

The present embodiment is different from the above-described first embodiment in that the volume of the suction volume part 16A close to the suction port 22 is made larger by making a height of the step part of the tooth crest of the so-called scroll with the both side steps forming the suction volume part 16A, higher than a height of the step part of the tooth crest of the other scroll. The other points are similar to the first embodiment and are not described.

The configuration of the so-called scroll compressor 1 with both side steps is as described in FIG. 1 and FIG. 2. Further, FIG. 4 schematically illustrates the volumes of the two suction volume parts (the compression chambers) 16 formed with the phase difference of 180 degrees in an exploded manner, in which (B) is a cross-sectional diagram of the scroll compressor 1 with both side steps corresponding to FIG. 2, (A) is an exploded diagram of the volume of the suction volume part 16B formed away from the suction port 22, and (C) is an exploded diagram of the volume of the suction volume part 16A formed close to the suction port 22.

As described above, in the scroll compressor 1 with both side steps, the respective volumes of the two suction volume parts (the compression chambers) 16A and 16B formed with the phase difference of 180 degrees are volumes obtained by adding volume portions B1 and B2 formed by the step parts 14C and 15C of the tooth crests and volume portions C1 and C2 formed by the step parts 14D and 15D of the bottom lands to the volume portions A1 and A2 as bases, respectively, as illustrated in FIG. 4(A) and FIG. 4(C).

Therefore, to establish "the suction volume part 16A>the suction volume part 16B", out of the volume portions B1 and B2 that are larger than the volume portions C1 and C2 and formed by the step parts 14C and 15C of the tooth crests, a dimension L1 of the volume portion B1 of the suction volume part 16A in the height direction is made higher than a dimension L2 of the other volume portion B2 in the height direction to establish "L1>L2". This makes it possible to effectively establish "the suction volume part 16A>the suction volume part 16B" as for the volumes of the two suction volume parts (the compression chambers) 15A and 15B. In other words, making the height of the step part 14C of the tooth crest that forms the suction volume part 15A close to the suction port 22 higher than the height of the step part 15C of the tooth crest that forms the other suction volume part 16B allows for establishment of "the suction volume part 16A>the suction volume part 16B".

In other words, the height of the step 15D provided on the end plate 15A of the turning scroll 15 is made higher than the height of the step part 14D provided on the end plate 14A of the fixed scroll 14, and the height of the step part 15C provided on the scroll lap 15B of the turning scroll 15 is made lower than the height of the step part 14C provided on the scroll lap 14B of the fixed scroll 14. This configures the scroll compressor 1 with both side steps having different heights, and makes if possible to establish "the suction volume part 16A>the suction volume part 16B".

As for the respective step parts 14C and 15C on the tooth crests and the respective step parts 14D and 15D on the bottom lands of the fixed scroll 14 and the turning scroll 15, the step part 14C on the tooth crest of the fixed scroll 14 engages with the step part 15D on the bottom land of the turning scroll 15, and the step part 14D on the bottom land of the fixed scroll 14 engages with the step part 15C on the tooth crest of the turning scroll 15. Therefore, when the height of the step part 150 provided on the end plate 15A side of the turning scroll 15 is denoted by L1, and the height of the step part 14D provided on the end plate 14A of the fixed scroll 14 is denoted by L2, it is sufficient to set the heights L1 and L2 so as to establish "L1>L2".

As described above, in the so-called scroll compressor 1 with both side steps, the height of the step part 14C of the tooth crest of the scroll forming the suction volume part, (the compression chamber) 16A that is close to the suction port 22 and sucks the lower-temperature refrigerant gas is made higher than the height of the step part 15C on the tooth crest of the other scroll. This makes it possible to establish "the suction, volume part 16A>the suction volume part 16B" as for the volumes. In addition, it is possible to efficiently suck the low-temperature refrigerant with high density into the suction volume part (the compression chamber) 16A formed close to the suction port 22, and to effectively increase the suction amount of the refrigerant.

Accordingly, it is possible to increase the displacement of the compressor by the amount, and to easily improve the volumetric efficiency and refrigerating capacity of the scroll compressor 1 only by making the height of the step part 15D on the bottom land of the turning scroll 15 and the height of the step part 14C on the tooth crest of the fixed scroll 14 higher. In addition, securing cooling performance and lubricity of the low-temperature suction refrigerant gas for the mechanical parts such as the bearings 6 and 11 and the drive bush 10 makes it possible to achieve both of securement of service life of the equipment and high performance of the compressor 1 by improvement of the volumetric efficiency.

In other words, in the exploded diagram of the suction volume part 16A illustrated, in FIG. 4(C), the volume portion B1 having a crescent shape (the shape same as the base volume portion) and a volume portion C1 having a semi-crescent shape (a shape in which a crescent is cut in the middle) are provided, and the crescent volume portion B1 having a large area is larger in volume when the height of the step part is increased. Therefore, making the height of the step part 14D (=15C=L2) on the bottom land located in the suction volume part 16A lower than the height of the other step part 15D (=14C=L1) allows for establishment of "the suction volume part 16A>the suction volume part 16B".

As described above, the crescent volume portion B1 (L1) is compared with the volume portion B2 (L2), and it is sufficient to increase the height of the volume portion, the volume of which is desired to be increased, out of the two suction volume parts 16.

Modification

The above-described second embodiment may be modified as follows.

In the second embodiment, the step parts 14C and 15D that engage with each other and the step parts 14D and 15C that engage with each other are made different in height from each other, which establishes "the suction volume part 16A>the suction volume part 16B" as for the volumes of the two suction volume parts 16, in the so-called scroll compressor 1 with both side steps in which the step parts 14C, 15C, 14D, and 15D are provided on the tooth crests and the bottom lands of the scroll laps 14B and 15B of the paired fixed scroll 14 and turning scroll 15. Even in a case of a so-called scroll compressor 1 with one side step, however, it is possible to establish "the suction volume part 16A>the suction volume part 16B", as with the above-described embodiment.

In other words, one of the paired fixed scroll 14 and turning scroll 15 is configured as a scroll including the step part 14D or 15D only at the predetermined position, along the spiral direction, of the bottom land of the scroll lap 14B or 15B, and the other scroll is configured as a scroll including the step part 14C or 15C only at the predetermined position, along the spiral direction, of the tooth crest of the scroll lap 14B or 15B that corresponds to the step part 14D or 15D of the bottom land of the one scroll. This results in the scroll compressor 1 with one side step in which the step part is provided only on the end plate of one of the scrolls. Further, the volume formed by the step part 14C or 15C on the tooth crest is added only to the volume of the suction volume part 16A that is formed close to the suction port 22, out of the two suction volume parts (the compression chambers) 16 formed with the phase difference of 180 degrees, which allows for establishment of "the suction volume part 15A>the suction volume part 16B".

The above-described configuration also makes it possible to establish "the suction volume part 16A>the suction volume part 16B" as for the volume of the suction volume part 16A formed close to the suction port 22 out of the two suction volume parts (the compression chambers) 16 formed with the phase difference of 180 degrees, and to efficiently suck the low-temperature refrigerant with high density into the suction volume part (the compression chamber) 16A close to the suction port 22 to effectively increase the suction amount of the refrigerant. Accordingly, it is possible to increase the displacement of the compressor fey such an amount and to easily improve the volumetric efficiency and refrigerating capacity of the scroll compressor 1. Furthermore, it is possible to achieve both of securement of service life of the equipment and high performance of the compressor 1 by improvement of the volumetric efficiency by securing cooling performance and lubricity of the suction refrigerant gas for the mechanical parts.

Figure 4:
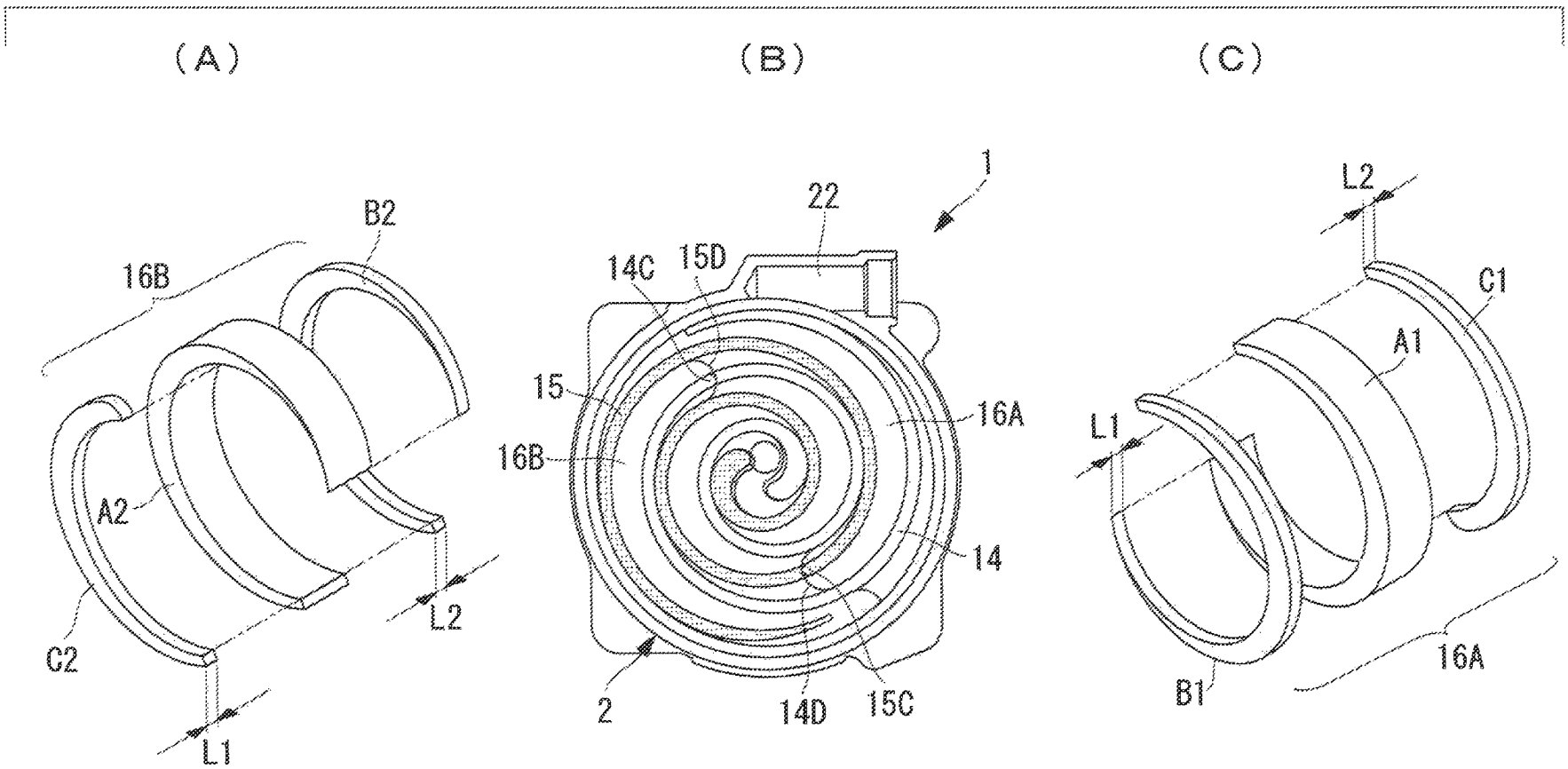
FIG. 4(B) is a diagram of a scroll compressor according to a second embodiment of the present invention, corresponding to a cross-sectional surface taken, along line A-A in FIG. 1, and FIGS. 4(A) and 4(C) are schematic diagrams respectively illustrating volumes of two suction volume parts.

Note that, in the case of the scroll compressor 1 with one side step, out of the two suction volume parts (the compression chambers) 16A and 16B formed with the phase difference of 180 degrees, the suction volume part 16B formed away from the suction port 22 has a configuration equivalent to the configuration of the suction volume part 16B illustrated in FIG. 4 front whim the volume portion B2 formed by the step part 15C on the tooth crest is removed.

Third Embodiment

Next, a third embodiment of the present invention is described with reference to FIG. 5.

The present embodiment is different from the above-described first and second embodiments in that, out of respective surface areas of the fixed scroll 14 and the turning scroll 15 that form the two suction volume parts (the compression chambers) 16 (16A and 16B) formed with the phase difference of 180 degrees, the surface area of the end plate 15A of the turning scroll 15 that is disposed to face the suction region 21 of the low-temperature low-pressure refrigerant gas sucked through the suction port 22 is made larger than the surface area of the end plate 14A of the fixed scroll 14. The other points are similar to those in the first and second embodiments and are not described.

In other words, in the present embodiment, in the so-called scroll compressor 1 with both side steps, the height of the step part 15D provided on the end plate 15A of the turning scroll 15 that is disposed to face the suction region 21 of the low-temperature low-pressure refrigerant gas is made higher than the height of the step part 14D provided on the fixed scroll 14 to increase surface area S1 of the turning scroll 15 forming the suction volume part (the compression chamber) 16, as compared with the fixed scroll 14, a surface on the scroll lap side of the end plate of which is disposed to face the discharge chamber 20 from which the high-temperature high-pressure gas is discharged. This further reduces the temperature in the suction volume part to improve the suction efficiency, and to effectively increase the suction amount of the refrigerant.

Figure 5:
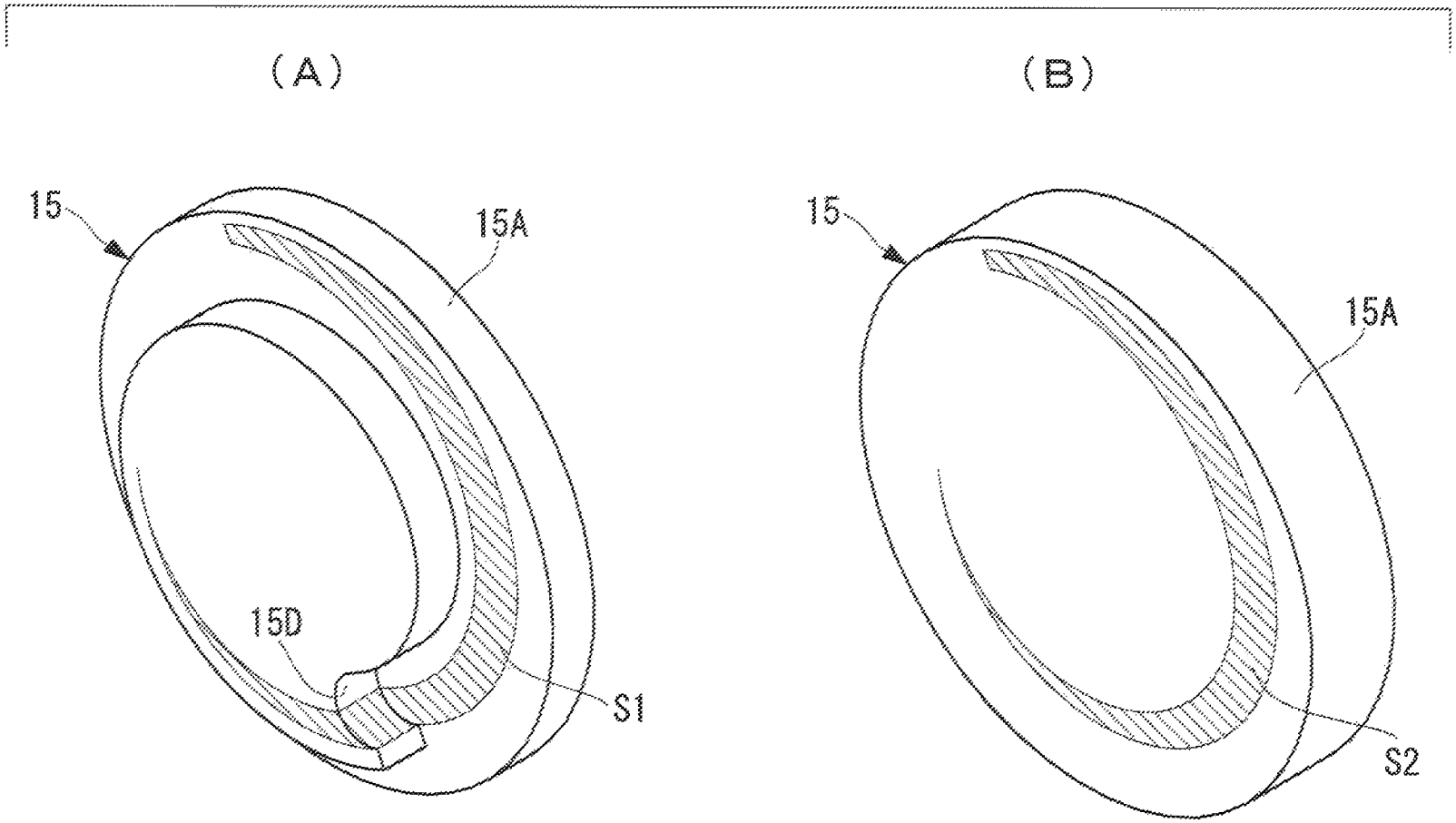
FIGS. 5(A) and 5(B) are schematic diagrams each illustrating a surface area forming a suction volume part of an end plate of a turning scroll of a scroll compressor according to a third embodiment of the present invention.

FIG. 5 illustrates the surface areas S1 and S2 by hatching when the end plate 15A of the turning scroll 15 forms one of the suction volume parts (the compression chambers) 16. FIG. 5(A) illustrates a case where the step part 15D is provided on the end plate 15A, and FIG. 15(B) illustrates a case where the step part 15D is not provided. It is found from the drawings that, as compared with the surface area S2 in the case where the step part 151) is not provided, the surface area S1 in the case where the step part 15D is provided increases the surface area of the end plate 15A forming the suction volume part 16 (S1>S2), and making the height of the step part 15D provided on the end plate 15A of the turning scroll 15 higher than the height, of the step part 14D of the fixed scroll 14 allows for increase of the surface area of the end plate 15A forming the suction volume part 16 in the case where the step parts 14D and 15D are respectively provided on the end plates 14A and 15A of the both scrolls 14 and 15.

The present embodiment is configured as follows, on the basis of the above-described knowledge.

(1) In the case of the so-called scroll compressor 1 with both side steps in which the step parts 14C, 15C, 14D and 15D are provided at the respective predetermined positions, along the spiral direction, of the tooth crests and the bottom lands of the scroll laps 14B and 15B of the fixed scroll 14 and the turning scroll 15 to configure the compression mechanism 13, the surface area S1 of the end plate 15A of the turning scroll 15 forming the suction volume part 16 is made larger by making the height of the step part 15D provided on the bottom land of the turning scroll 15 higher than the height of the step part 14D provided on the bottom land of the fixed scroll 14.

(2) In addition, in the case of the so-called scroll compressor 1 with one side step in which the step part 14D or 15D is provided only at the predetermined position, along the spiral direction, of the bottom land of the scroll lap 14B or 15B of one of the fixed scroll 14 and the turning scroll 15, and the step part 14C or 15C is provided only at the position, along the spiral direction, of the tooth crest of the scroll lap 14B or 15B of the other scroll corresponding to the step part 14D or 15D on the bottom land, to configure the compression mechanism 13, the surface area S1 of the end plate 15A of the turning scroll 15 forming the suction volume part 16 is made larger by providing the step part 15D only on the bottom land of the turning scroll 15.

With the above-described configuration, in the above-described case (1), in the so-called scroll with both side steps, out of the respective surface areas of the end plates 14A and 15A of the both scrolls 14 and 15 forming the two suction volume parts 16 (16A and 16B), the surface area S1 of the end plate 15A of the turning scroll 15 that is disposed to face the suction region 21 into which the low-temperature refrigerant gas is sucked, is made larger by making the height, of the step part 15D of the bottom land of the turning scroll 15 higher than the height of the step part 140 of the fixed scroll 14. This makes it possible to maintain the temperature inside the suction volume part 16 at lower temperature to improve the suction efficiency, and to effectively increase the suction amount of the refrigerant.

Accordingly, it is possible to easily improve the volumetric efficiency and the refrigerating capacity of the scroll compressor 1 only by making the height or the step part 15D provided on the end plate 15A of the turning scroll 15 higher to increase the surface area S1. In addition, securing cooling performance and lubricity of the suction refrigerant gas for the mechanical parts makes it possible to achieve both of securement of service life of the equipment and high performance of the compressor 1 by improvement of the volumetric efficiency.

Moreover, in the above-described case (2), in the so-called scroll with one side step, out of the respective surface areas of the end plates 14A and 15A of the both scrolls 14 and 15 forming the two suction volume parts 16 (16A and 16B), the surface S1 of the end plate 15A of the turning scroll 15 that is disposed face the suction region 21 into which the low-temperature refrigerant gas is sucked, is made larger by providing the step part 15D only on the bottom land of the turning scroll 15. This makes it possible to maintain the temperature inside the suction volume part 16 at lower temperature to improve the suction efficiency, and to effectively increase the suction amount of the refrigerant.

Accordingly, it is possible to easily improve the volumetric efficiency and the refrigerating capacity of the scroll compressor 1 only by providing the step 15D only on the end plate 15A of the turning scroll 15 to increase the surface area S1. In addition, securing cooling performance and lubricity of the suction refrigerant gas for the mechanical parts makes it possible to achieve both of securement of service life of the equipment and high performance of the compressor 1 by improvement of the volumetric efficiency.

Consequently, as described in the present embodiment, out of the respective surface areas of the end plates 14A and 15A of the both scrolls 14 and 15 forming the two suction volume parts (the compression chambers) 16, the surface area S1 of the end plate 15A of the turning scroll 15 that is disposed to face the suction region 21 on the low-temperature low-pressure side, is made lager than the surface area of the end plate 14A of the fixed scroll 14. This makes it possible to maintain the temperature inside the suction volume part 16 at lower temperature to improve the suction efficiency, and to effectively increase the suction amount of the refrigerant. Accordingly, it is possible to improve the volumetric efficiency and the refrigerant capacity of the scroll compressor 1.

In addition, since the mechanical parts such as bearing parts are cooled and lubricated by the low-temperature refrigerant gas that is sucked into the suction volume part (the compression chamber) 16B away from the suction port 22, it is possible to achieve both of securement of service life of the equipment and high performance of the compressor 1 by improvement of the volumetric efficiency.

Note that the present invention is not limited to the inventions according to the above-described embodiments, and the present invention may be appropriately modified without departing from the scope of the invention. For example, in the description of the above-described embodiments, the winding finish end of the fixed scroll 14 is disposed at the upper part, and the winding finish end of the turning scroll 15 is disposed at the lower part. The winding finish ends of the scrolls, however, may be disposed reversely. In this case, the steps 14C, 15C, 14D, and 15D are also disposed reversely as a matter of course.

In addition, in the above-described embodiments, the example in which the invention is applied to a lateral scroll compressor has been described; however, the invention is similarly applicable to a vertical scroll compressor, a sealed scroll compressor, and the like as a matter of course.

EXPLANATION OF REFERENCE

1 Scroll compressor
14 Fixed scroll
15 Turning scroll
14A, 15A End plate
14B, 15B Scroll lap
14C, 15C Step part on tooth crest
14D, 15D Step part on bottom land
16, 16A, 16B Suction volume part (compression chamber)
21 Suction region
22 Suction port
23 Increased-number-of-turns section
A1, A2 Base volume portion
B1, B2 Volume portion by step part on tooth crest
C1, C2 Volume portion by step part on bottom land
L1, L2 Height of step part
S1, S2 Surface area forming suction volume part

The invention claimed is:

1. A scroll compressor that forms two suction volume parts by engaging paired fixed scroll and turning scroll with each other while scroll laps are opposed to each other and driving the turning scroll to revolve around the fixed scroll, the scroll laps being respectively erected on end plates of the fixed scroll and the turning scroll, wherein a crank shaft that turns the turning scroll is provided, each of the fixed scroll and the turning scroll includes step parts at respective predetermined positions, along a spiral direction, of a tooth crest and a bottom land of the scroll lap, and out of the two suction volume parts, one suction volume part that is formed close to a suction port providing in a housing is made larger than the other suction volume part by making a height of the step part of the tooth crest of one of the fixed scroll and the turning scroll forming the suction volume part higher than a height of the step part of the tooth crest of the other scroll.

2. A scroll compressor that forms two suction volume parts by engaging paired fixed scroll and turning scroll with each other while scroll laps are opposed to each other and driving the turning scroll to revolve around the fixed scroll, the scroll laps being respectively erected on end plates of the fixed scroll and the turning scroll, wherein a crank shaft that turns the turning scroll is provided, one of the fixed scroll and the turning scroll includes a step part only at a predetermined position, along a spiral direction, of a bottom land of the scroll lap, the other scroll includes a step part only at a predetermined position, along a spiral direction, of a tooth crest of the scroll lap, the predetermined position corresponding to the step part on the bottom land, and out of the two suction volume parts, one suction volume part that is formed close to a suction port is made larger than the other suction volume part by adding, only to the one suction volume part, a volume that is formed by the step part on the tooth crest of the scroll lap of the other scroll.

3. A scroll compressor that forms two suction volume parts by engaging paired fixed scroll and turning scroll with each other while scroll laps are opposed to each other and driving the turning scroll to revolve around the fixed scroll, the scroll laps being respectively erected on end plates of the fixed scroll and the turning scroll, wherein a crank shaft that turns the turning scroll is provided, each of the fixed scroll and the turning scroll includes step parts at respective predetermined positions, along a spiral direction, of a tooth crest and a bottom land of the scroll lap, and out of surface areas of the both scrolls forming the two suction volume parts, a surface area of the end plate of the turning scroll is made larger than a surface area of the end plate of the fixed scroll by making a height of the step part provided on the bottom land of the turning scroll higher than a height of the step part provided on the bottom land of the fixed scroll, the turning scroll being disposed to face a suction region of low-temperature refrigerant gas sucked through a suction port provided in a housing.

* * * * *